United States Patent [19]

Mucka

[11] 3,970,168

[45] July 20, 1976

[54] MUFFLER

[75] Inventor: John R. Mucka, Pittsburgh, Pa.

[73] Assignee: H. K. Porter Company, Inc., Pittsburgh, Pa.

[22] Filed: June 13, 1974

[21] Appl. No.: 478,909

Related U.S. Application Data

[60] Continuation-in-part of Ser. No. 484,587, July 1, 1974, Pat. No. 3,880,252, and a division of Ser. No. 365,956, June 1, 1973, abandoned.

[52] U.S. Cl. ..... 181/60; 181/46; 181/35 C; 181/36 B

[51] Int. Cl.[2] ..... F01N 1/10

[58] Field of Search ..... 181/35 R, 35 C, 36 R, 181/36 A, 36 B, 47 R, 47 A, 47 B, 49, 56, 60, 63, 64, 68

[56] References Cited

UNITED STATES PATENTS

| | | | |
|---|---|---|---|
| 734,749 | 7/1903 | Rauch | 181/60 |
| 1,162,064 | 11/1915 | Hutton | 181/60 |

FOREIGN PATENTS OR APPLICATIONS

| | | | |
|---|---|---|---|
| 123,337 | 8/1901 | Germany | 181/60 |
| 81,133 | 1/1920 | Germany | 107/60 |
| 587,752 | 10/1933 | Germany | 107/60 |
| 10,297 | 7/1911 | United Kingdom | 107/60 |
| 207,663 | 12/1923 | United Kingdom | 107/60 |

*Primary Examiner*—L. T. Hix
*Assistant Examiner*—Vit W. Miska
*Attorney, Agent, or Firm*—Parmelee, Miller, Welsh, & Kratz

[57] ABSTRACT

A muffler for internal combustion engines, compressed air tools and the like, has a tubular core with one end having a connection with a source of exhaust gases and the other end closed or valved in such manner as to prevent build-up of back pressure with an increase of exhaust gas flow above a selected maximum. Intermediate its two ends a length of the core is perforated around its entire periphery. A succession of dished annuli are fitted about a perforated area of the core with alternate annuli reversed so that they are arranged in several pairs with the peripheral edges of each pair converging to form between them an attenuation chamber from which gases entering the chambers through the central core escape at the peripheries of the chambers, the larger circumference of the gas escape passages at the peripheries of the chambers in relation to the gases entering the chambers through the perforations in the tube relieving the pressure while the sound is attenuated to a greatly reduced level.

4 Claims, 11 Drawing Figures

MUFFLER

This application is a continuation-in-part of my application Ser. No. 365,956 filed June 1, 1973 now abandoned, and a division of this application, Ser. No. 484,587 filed July 1, 1974 has now issued as U.S. Pat. No. 3,880,252 granted April 27, 1975.

The invention is for a device intended primarily for use as a muffler for internal combustion engines, compressed air machinery including tools and elsewhere if the noise of escaping gates and their release into the atmosphere is to be muffled or reduced.

Since the invention is primarily designed for use as a muffler for internal combustion engines and compressed air tools, it will be herein so described for purposes of illustration but without excluding other uses where confined gases are released to atmosphere at greatly reduced pressure.

With the increased use of internal combustion engine and compressed air tools and machinery, much study has been given to the development of a muffler which would reduce exhaust noise to a more acceptable level. The injurious effects of "noise pollution" and the need to protect workmen from exhaust noise is recognized as a health problem. The present invention is designed to provide a relatively inexpensive muffler of a unique construction, less susceptible to corrosion, but which in tests in both government and private laboratories has been proved to be exceptionally effective.

The present invention provides a muffler of compact construction which has proved to be equally or more effective in cases where it has been tested than a favored conventional type muffler presently in wide use, but it is relatively more compact, self-cleaning and incapable of retaining condensate or corrosive exhaust products. It is designed to produce minimum back pressure in the exhaust system of the air or combustion engine with which it is used, and desirably it may be constructed to adjust either manually or automatically with limits over a range in the volume of exhaust gases delivered by an engine or air motor. Because of its compact construction it is especially well adapted to use on portable compressed air and internal combustion engine-driven tools, including air-driven percussion tools, power lawn mowers, chain saws, etc., where present mufflers are quite ineffective, but it can also be advantageously and effectively used on automobiles, tractors, stationary air-operated machinery and elsewhere, particularly where under normal conditions the engine operates at a fairly uniform speed so that under normal conditions the exhaust gas volume is fairly constant.

The muffler of this invention comprises a tubular core having one end threaded or otherwise formed for connection into an exhaust port of an engine, or applied to an exhaust pipe, or attached to some other source of exhaust gases to be muffled. A portion of the length of the core intermediate its ends has numerous closely-spaced openings therethrough around the entire periphery of the core. Around one end of the core there is provided an annular abutment. The other end of the core is completely or partially closed as hereinafter described. Around the outside of the perforate area of the core are slidably fitted a plurality of washer-like concavo-convex annuli or disks alternately reversed so as to be arranged in pairs where the concave surfaces of each pair are in confronting relation and their peripheral edges converge toward each other, an attenuation chamber being thereby provided between the annuli of each pair. Exhaust gases entering the core will flow through the numerous openings in the core into the attenuation chambers and escape from around the periphery of each chamber through a narrow annular gap between the converging edges of the confronting annuli. The series of annuli so provided are confined at one end by said fixed abutment, and at the other end by a second abutment which may in some cases be adjusted toward or away from the first. In some cases the annuli are so formed that they may be pressed tightly against one another and still provide a gas escape passage around the periphery of each pair, and in other cases one abutment may be adjustable toward and away from the other to vary the spacing between the confronting edges of the pairs of disks. This adjustment may be manual or automatic, or both. The assembled unit has an "accordion pleated" appearance with annular corrugations formed by the succession of annuli so arranged, providing in addition an effective heat-dissipating surface.

I am aware that it has heretofore been proposed, as disclosed in British Patent No. 10,297 of 1910 to Karthaus to provide a device for diffusing the exhaust gases from an engine into the atmosphere in such finely-divided thin streams as to render them invisible, and for this purpose there is provided a unit having two parallel pipes with a connector at one end into which the exhaust pipe of an engine discharges gases, and a connector at the other end through which the two pipes also communicate. Each pipe is perforated intermediate its ends around and along the greater portion of its length, and slidable on the pipes are a plurality of plate-like members which are so arranged that each two plates form a hollow body. The exhaust gases pass through the perforations in the pipe and enter the hollow bodies. A tension spring located between the two pipes is connected at each end to a follower that is sliable along both pipes so that the spring simultaneously exerts a yielding pressure against both ends of the series of piates on each pipe to hold all of the plates in each series tightly pressed against one another, so that the gases, entering the hollow bodies, escape under pressure. The escaping gases must be in such fine streams that they are said to become quickly invisible. In other words, the pressure builds up in the chambers between the pairs of disks to a point where the gases are forced out between contacting edges of the disks at high velocity. Just as with any other nozzle, the the gain in velocity must be secured at the expense of a decrease in flow and thereby build up a back pressure in the exhaust system. A build-up of pressure capable of achieving the result sought by this patentee must be substantial. This necessarily reduces the efficiency of the engine, and must also result in an increase in noise. Both results defeat the purpose of a muffler, which should eliminate back pressure as much as possible and discharge the exhaust gas as quietly as possible. While the device of this patent may have a superficial resemblance to the invention herein disclosed, it is in fact not a muffler nor would it or any similar device be a desirable accessory in the exhaust system of an engine or air motor.

The invention may be more fully understood by reference to the accompanying drawings showing a present preferred embodiment of the invention, but variously modified as particular use may require, and in which.

Figure 4:
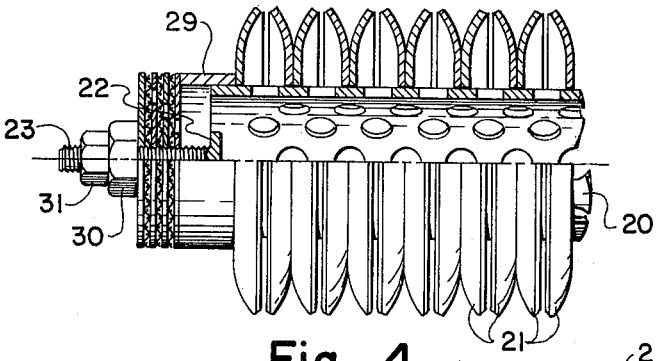
Figure 6:
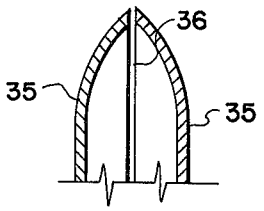
Figure 5:
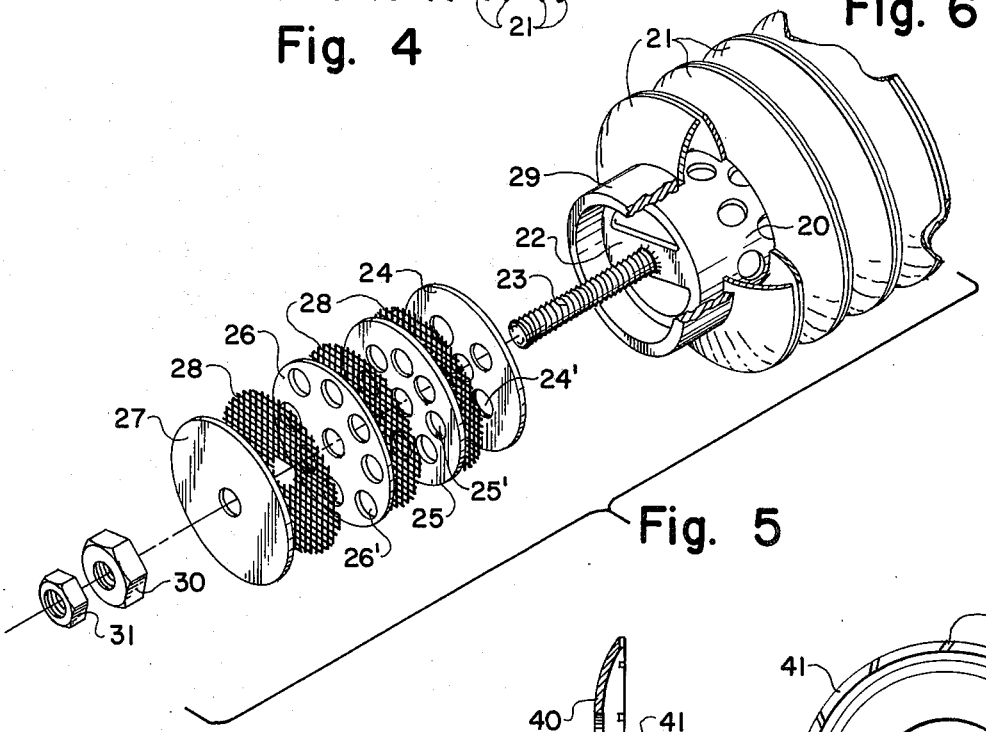
Figure 7:
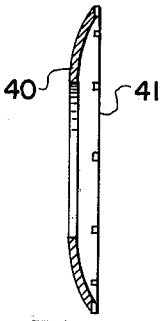
Figure 8:
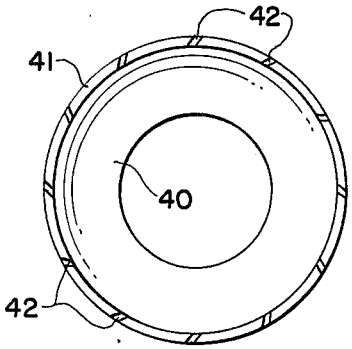
Figure 9:
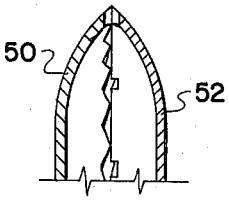
Figure 10:
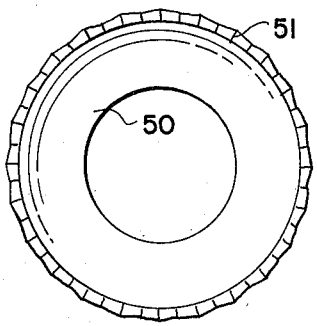

FIG. 4 is a fragmentary view partly in longitudinal section and partly side elevation of one end of a modified structure wherein the end closure structure for the tubular core comprises a resilient disk arrangement for yieldably venting gases from the tube directly to the atmosphere and thereby prevent a build-up of undesirable back pressure in the tubular core or the chambers between the several pairs of annuli, part of the circular screens in the drawing at the end being omitted for better illustration;

FIG. 5 is an exploded view of the modification shown in FIG. 4 to better illustrate the structure;

FIG. 6 is a fragmentary sectional view of a portion of two of the disks illustrating how their edges may be faced instead of presenting sharp edges in confronting to each other, as in FIGS. 1 to 4;

FIG. 7 is a vertical section through a modified form of disk wherein the faced edge of the disk has somewhat spirally-directed grooves therein;

FIG. 8 is a face view of FIG. 7;

FIG. 9 is a vertical section similar to FIG. 6 showing two opposed annuli designed with similar pairs of opposed annuli to be immovably jammed or pressed together and still provide a gas escape passage around the entire periphery of each chamber, one with projections, here shown as teeth-like serrations on the rim and the other with grooves in the rim;

FIG. 10 is a face view of the former of the two disks shown in FIG. 9.

Figure 11:
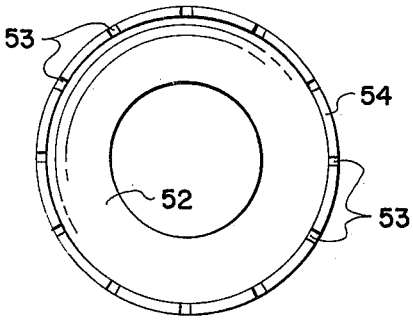

FIG. 11 is a face view of the other of the two disks shown in FIG. 9.

Figure 1:
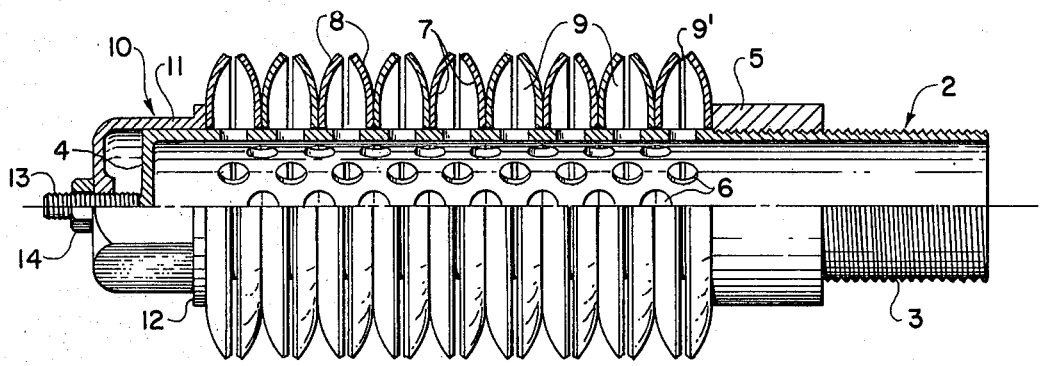
FIG. 1 is a side elevation of the complete muffler with the upper half in section.
Figure 2:
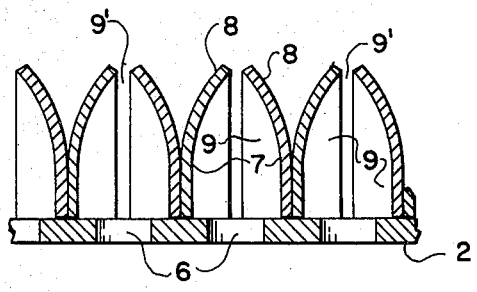
FIG. 2 is a fragmentary sectional view on a larger scale of a portion only of the periphery of the muffler.
Figure 3:
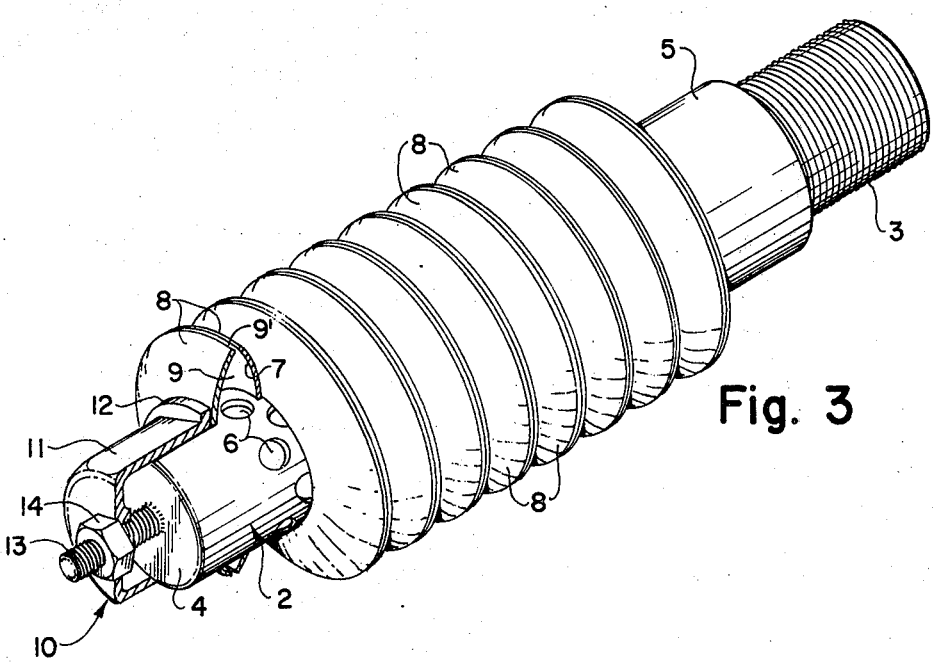
FIG. 3 is a perspective view of the complete muffler with some of the disks and part of the end cap cut away to better illustrate the construction.

Referring first to FIGS. 1 to 3 of the drawings, 2 designates generally a core member comprising a tubular metal body having one end 3 externally threaded or otherwise formed for connection with a source of gas to be muffled or diffused and having its opposite end closed or plugged as indicated at 4. The threaded end of the body has a sleeve 5 thereabout forming an annular shoulder or abutment. The major portion of the area of the core intermediate the abutment 5 and the opposite end has numerous closely-spaced openings 6 therethrough which may be round holes, slits or other small openings. Fitted over the outside of the core with a sliding fit are a succession of disks or annuli 7 of similar construction, each being dished or concavo-convex, and every other one is reversed with respect to the adjacent ones so as to form confronting pairs of such annuli with the peripheral edges 8 converging and providing between each such pair an annular space or chamber 9 into which gases from the interior of the core escape from the core through the perforations 6. These chambers constitute attenuation chambers from which gases freely escape through gaps 9′ between the confronting edges of the annuli. The drawings, for purpose of clarity, indicate these gaps as being wider than necessary in a muffler of the size here indicated.

These annuli are preferably stamped from heat and rust-resistant ferrous metal alloy. The series of annuli so arranged are confined against the abutment 5 at one end of the perforated area and by another member at the other end which may also be adjustable. This adjustable member is here shown as a cap-like member 10 with a skirt 11 fitting over the core and having a lip 12 that bears against the endmost disk or annulus at the other end of the perforated area. The exterior of the skirt may have flattened surfaces thereon to which a wrench may be applied. The end of this cap has a central perforation fitted over or screwed onto a threaded stud 13 projecting from the closed end of the core. A retaining nut 14 is on this stud. By adjusting the cap with respect to the succession of disks the distance between the abutment 5 and cap 10 can be adjusted, this arrangement providing in effect a micrometer adjustment and thus control the total clearance or widths of the gaps 9′ between the several pairs of annuli.

In FIGS. 1 to 3 of the drawings the converging confronting edges of the disks are shown slightly separated. This separation occurs because the adjustable member or cap 10 is set that there is slight looseness of the series of annuli between the abutments 5 and 10. As soon as the muffler is put into operation, the initial effect of the exhaust gases flowing into the attenuation chambers from the perforated pipe causes the pairs of annuli to distribute themselves in such manner that thte space or peripheral gap between the edges of the annuli of each pair is for all practical purposes, the same as the space or gap between the edges of all other pairs of annuli in the series for a selected size of muffler. This may result in some slight looseness when the muffler is not operating, but after operation is started, this looseness allows the annuli to self adjust in the manner above described. As here shown where round holes are provided in the tubular core their diameter is preferably less than the width of the distance 9 between confronting disks, and the spacing between holes from edge-to-edge is about the same as the hole diameter. The holes are generally staggered so that the pairs of annuli do not necessarily center over all of the holes in the manner in which they appear to in FIG. 2. The area of all the holes 6 opening into any one chamber 9 is desirably less than the area of the peripheral outlet gap 9′ so there should be little impedance to the escape of gases at low velocity from the several gaps 9′ and little build-up of back pressure.

As in any muffler, the muffler of the present invention produces some back pressure on the exhaust gases and the adjustable cap can regulate this within desirable limits. However, the total area of all of the holes should be such as to accomodate the entire output of gases for which the muffer is designed. Since the annuli as shown are materially larger in diameter than the outside diameters of the tubular core, the velocity of flow of the gases away from the core in each chamber decreases toward the periphery, but desirably the flow is turbulent, and any more or less laminar flow of gases from the chambers to the atmosphere is impeded by the curvature of the disks, but pressure build-up in the chambers is minimized. The curvature also functions to suppress sound by the non-uniform and opposing reflection of sound, and there is a consequent attenuation of noise.

In FIGS. 4 and 5 there is disclosed a modification wherein the annuli are confined at one end of the series by an end closure which also provides a restricted outflow for a small portion of the exhaust gases directly from the end of the tubular core. In the construction here shown the tubular body 20 is generally similar to that shown in FIG. 1 and the succession of confronting annuli 21 are arranged thereon as described in FIGS. 1 to 3, and since the only significant difference is at the end opposite the gas inlet end, only this end of the unit remote from the inlet end has been shown, and it will be understood that the abutment such as 5 of FIG. 1 near the inlet end which must also be provided, is not shown.

In FIGS. 4 and 5 the end of the tubular core remote from the inlet end does not have a fixed completely solid end closure as in FIG. 1, but has a transverse web or strip 22 fixed therein which leaves a large part of the end of the tubular core open. This web has a threaded post or stud 23 projecting axially therefrom beyond the end of the tubular core. There is an end closure comprising one or more resilient disks on this post as shown in the drawings. Here there are four such disks 24, 25, 26 and 27, each having a central hole therethrough through which the post 23 passes, and the diameter of each disk is about the same as the outside diameter of the collar 29 that is slidably fitted over the body 20. Each of these disks except the outermost one, 27, has a plurality of openings 24', 25' and 26' respectively therethrough, with the number of openings or the extent of open area increasing in the series from the fewest openings in 24 to the most openings in 26, each series of openings also being located further from the center of the disk than the preceding openings. Between each two confronting disks there is a disk 28 of close-mesh wire screen.

Between the edge face of disk 24 and the endmost pair of confronting disk or washers there is the collar 29 that has a sliding fit over the end of the core 20. Finally there is a nut 30 screwed onto the post 23 to confine the end closure assembly of resilient disks and screens against the outer end of the collar. By taking up on the nut 30, the pressure applied against the collar can be increased. A jam nut 31 may also be screwed onto the post 23 to prevent the nut 30 from working loose. The adjustment is made in such manner that the confronting annuli will separate from each other at the periphery, as described in connection with FIG. 1, so that there is an annular gap between the edges of each confronting pair of annuli with the gaps all being uniform.

In operation where this device is used on an internal combustion engine where the volume of exhaust gases is subject to wide variation, there may be adequate freedom for the escape of all of the gasesfrom between the confronting pairs of annuli 21 when the engine is idling or at normal speed, but as the volume of gases increases, tending to build up back pressure in the tubular core of the muffler, the end closure will be subject to the increasing fluid pressure in the core, flexing end closure to move the collar 29 in a direction away from the end of the series of annuli, allowing them to self-adjust to a slightly larger clearance between the converging edges to thereby allow a more free flow of gases from the chambers to the air, and this flexing of the end closure also allows for the escape of exhaust gases to the atmosphere.

The end is preferably formed of several resilient disks separated from one another by wire screen, first to secure a wider range or resilience in response to exhaust gas pressure than is provided by a single thicker disk, and more importantly to provide for the controlled escape of some of the exhaust gases through the holes in the disks and outwardly past the screens. This also protects the disks from the heat. The exhaust gas passing through the holes in the resilient disks expands between the disks which results in a cooling of the gases, and as the cooler gases decrease in volume, additional openings allow freer flow of the decreased volume to pass through the openings in the next where they expand further, while the screens increase the cooling effect and control the escape of gases at the periphery of the end closure assembly. As a result, all of the resilient disks are cooled and the end disk 27 particularly is fairly cool, even at high speeds, and the arrangement further provides for an increasing volume of exhaust to quietly escape at the end of the muffler as the volume of exhaust gases increases. Cooling of the resilient disks of course protects the temper which gives the disks their resilience.

In FIGS. 1 through 5 the annuli 21 are all shown with only their inner edges angularly disposed with respect to one another. FIG. 6 shows a modification where the confronting peripheral edges of the annuli 7 and 21 of FIGS. 1 through 5 are flat surfaces. It is often desirable to "face" these edges, as shwon in FIG. 6 so that the exhaust gases escape through a somewhat more slit-like peripheral passage between each pair of dished annuli, the faced surfaces of the two annuli being substantially parallel. In FIG. 6, 35 designates each of the two dished annuli of a pair and the inwardly-converging edges are made flat or faced, as at 36. This facing of the annuli avoids the confronting angular edges as shown in FIG. 2 and reduces noise which results when gases move at certain velocities over angular surfaces. The width of the confronting faces so formed is wider than the thickness of the metal in the converging edges because the metal is faced across a sloping section of metal. It is of course intended that these annuli 35 may be substituted for those shown in FIGS. 1 through 5.

With the annuli faced in the manner shown in FIG. 6 it is possible to form grooves in or projections on the flat faces to impart some directional effect to the escaping gases. For example, in FIGS. 7 and 8, each annulus 40 has a flat face 41 that will confront a similar face of another annulus in the manner previously described. However, one or both of the confronting flat faces may have numerous somewhat spirally-directed grooves 42 therein so that even when the two annuli are in face-to-face contact, there are nevertheless grooves which provide exhaust gas escape passaged arranged to produce a swirling effect to the gases about the muffler, or if two like annuli are placed together the grooves may cooperate in such manner that the escaping exhaust gases will form numerous eddies around the several gas escape passages of each confronting pair of annuli. Even though pressed tightly together, each such two annuli will provide for the free escape of gases to the atmosphere around the peripheral edges of each pair of annuli. The grooves in this case being so numerous and so proportioned that while they give direction to the discharge of gases they do not appreciably retard the outflow of gases or create back pressure of noticeable magnitude.

FIGS. 9, 10 and 11 show another modification of the annuli. In this view there is shown a left annulus as viewed in FIG. 9 and a face view of which is shown in FIG. 10, and there is right annulus, a face view of which is shown in FIG. 11. In FIGS. 9 and 10 the left-hand annulus is designated 50. On the face which confronts the opposite annulus there is a series of spaced projections or teeth 51. The opposite or right-handed annulus or annulus 52 could have a smooth face, as in FIG. 6, but preferably it has a series of spaced grooves 53 around the periphery, the grooves being less numerous than the teeth of annulus 30. The grooves in effect divide the peripheral face of the washer into a succession of separate flat surfaces of lands 54, the arrangement being such that as with the construction shown in FIGS. 7 and 8, there are always gas outlets around the periphery of the chambers formed between the annuli even when the annuli are immovably pressed together, as by tightening nut 14 of FIGS. 1 and 3 or nut 30 of FIGS. 4 and 5. Through these spaces the gases will escape and noise be muffled as the gases are discharged around the confronting peripheries of each pair of annuli. With "flats" or lands on the rim of one annulus and teeth on the other, the teeth cannot all register with grooves and thereby the closing of the grooves by opposing teeth meshing into them cannot happen and a fixed gas escape passage around the edges of each confronting two annuli is assured. Also projections may be provided at intervals around both annuli, but with those of one annulus rotated out of register with those of the other annulus of the pair.

In every case where parts could be interchanged this invention contemplates that they could be interchanged. For example, all of the annuli of FIGS. 1 or 4 could be replaced with the annuli of FIGS. 7 and 8, or of FIGS. 9, 10 and 11, or combinations of two or three kinds of annuli may be used on the same tubular core.

Summarizing, there are disclosed three modifications of the basic idea. In the first, the annuli are confined between two abutments with just enough looseness that the pairs of annuli will self adjust to allow a peripheral exhaust gas escape passage around the periphery of the chamber formed between each pair. This can be adjusted with great accuracy by adjusting at least one abutment but controlled so that no pair can separate to a point where the chamber 9 ceases to be an effective attenuation chamber. At the same time, no muffler for a given gas flow should so restrict the gas flow as to generate any considerable back pressure. Ideally each attenuation chamber should operate as close to atmospheric pressure as possible, with the velocity and pressure of the gas in the chamber diminishing toward the periphery of each chamber. The larger the diameter of the annuli relative to the core, the more will the gases expand and lose velocity as they move toward the peripheries of the attenuation chamber, although for a selected volume of gas there is obviously no point in increasing the diameter of the annuli.

In the second form, as the volume of exhaust gases increases, the slidable collar moves slightly away from one end of the series of annuli giving them more room to separate and more freely vent gases around their peripheries, and to some extent excess exhaust gas flow is vented at the end of the tubular core.

In the third form, the annuli are immovably jammed together between the abutments but projections or teeth on the edge of at least one assures of there being an exhaust gas outlet around the periphery of each chamber formed by each pair of confronting annuli.

In none of these three modifications is it intended, and the structure is so designed, that there is normally no considerable exhaust gas pressure in the chambers between the several pairs of disks. Never is pressure between the pairs of annuli used to move the abutment elements relatively to each other or to the tubular core.

In general, the muffler provides a uniform series of attenuation chambers between concavo-convex annuli arranged in pairs with the concave surfaces of the two annuli of each pair confronting one another and with a gas escape passage around the periphery of each chamber. Gases passing into these chambers through the perforations in the core lose velocity as they flow radially outward in all directions away from the tube and leave the periphery of the chamber at low velocity. Because of the large diameter of the annuli relatively to the tubular core, a small gap around the periphery of the chamber provides a relatively long gas escape port. For example with disks 1½ inches in diameter, the slot around the periphery is slightly more than 4.5 inches, and if there are as few as four pairs of annuli the combined length of the chamber outlets is close to one and one-half feet. Consequently an adjustment that provides even as little as 0.005 inch in the width of the gap at the periphery of each chamber gives an effectively large increase in the total gas escape "port area".

The concave or dished surfaces of the annuli not only increase turbulence in the expansion and outflow of gases from the chamber, but the extreme variation in sound reflection patterns within the chamber effectively reduces or attenuates sound emanation from the muffler.

While the device as here illustrated has been designed primarily for use as a muffler, it may be used to diffuse gases under pressure into an enlarged enclosure or the ambient air in a regulated volume and without producing any objectionable or disturbing noises or sound.

I claim:

1. A muffler for reducing exhaust gas noise generated by internal combustion engines, air-driven tools and machines and the like comprising:

a. a straight tubular body of uniform diameter having means at one end for connecting it to the exhaust of an internal combustion or air-driven motor and having a closure at its other end, a length of the tubular body intermediate its ends having perforations therein extending lengthwise and circumferentially of the tubular body, b. a series of generally substantially concavo-convex annuli all of the same diameter each having a central opening therethrough slidably fitted over the perforated lenght of the body, said annuli being arranged in several pairs in which the concave surfaces of the annuli of each pair are in confronting relation, each annulus having a flat central portion in which is the hole into which the tubular body is slidably fitted, the peripheral edge portion of the annuli of each pair being turned inwardly toward the peripheral edge portion of the other annulus of the pair, at least one annulus of each pair having spaced projections thereabout arranged to engage the confronting edge portion of the other annulus of the pair to provide between said confronting edge portions of each pair a circumferentially extending exhaust gas outlet which discharges directly to the ambient atmosphere, all of the projections in the muffler being of uniform height whereby the circumferentially extending exhaust gas outlets around each pair of confronting annuli is the same for all of the pairs, the spaces between the confronting faces of each such pair of annuli providing attenuation chambers around the tubular core into which the perforations in the tubular core discharge exhaust gases, the shape of said chambers being defined by the concave shapes of the confronting walls of the annuli, the circumferentially-extending exhaust gas outlet of each chamber having an area open directly to the atmosphere at least as great as te combined area of all of the perforations that open from the tubular body into each such chamber to avoid the build-up of back pressure in said attenuation chambers, the flat central areas of each annulus making face-to-face contact with the flat areas of the adjacent annulus whereby the annuli support one another against becoming tilted and thereby assure that the confronting edges of each pair of annuli are parallel around the periphery of each attenuation chamber; and c. an abutment on the tubular body at each end of said series of annuli serving to confine the series of annuli on the tubular body over the perforated length of said body.

2. The muffler defined in claim 1 wherein at least one of the abutments has a manually-adjustable screw-threaded engagement with the tubular body for adjusting it toward or away from the other abutment.

3. The muffler as defined in claim 1 in which the edge of at least one of the annuli of each pair has projections thereabout for engaging the confronting edge of the other annulus of each pair to hold the peripheral edges of the annuli of each pair uniformly spaced, said abutments serving to apply pressure to the series of annuli and hold them against relative rotational or longitudinal movement on the tubular core.

4. A muffler as defined in claim 1 in which the closure at the end of said tubular body is movable axially of the tubular body from a tube closing position to a tube venting position whereby when pressure in the tubular body exceeds a predetermined amount said closure will move to tube venting position to allow the escape of gases from said end of the tubular body, and biasing means for normally urging said end closure to tube closing position.

* * * * *